US006439178B1

(12) United States Patent
Pierik

(10) Patent No.: US 6,439,178 B1
(45) Date of Patent: Aug. 27, 2002

(54) MECHANICAL LASH ADJUSTER APPARATUS FOR AN ENGINE CAM

(75) Inventor: Ronald J. Pierik, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/875,649

(22) Filed: Jun. 6, 2001

Related U.S. Application Data

(63) Continuation-in-part of application No. 09/755,345, filed on Jan. 5, 2001.

(51) Int. Cl.[7] ..... F01L 13/00; F01L 1/20; F01L 1/30

(52) U.S. Cl. ..... 123/90.16; 123/90.17; 123/90.24; 123/90.43; 123/90.45

(58) Field of Search ..... 123/90.15, 90.16, 123/90.17, 90.22, 90.24, 90.25, 90.31, 90.39, 90.41, 90.43, 90.45, 90.6

(56) References Cited

U.S. PATENT DOCUMENTS

| | | | | | |
|---|---|---|---|---|---|
| 3,626,469 | A | * | 12/1971 | Ashley | 123/90.25 |
| 4,928,650 | A | * | 5/1990 | Matayoshi et al. | 123/90.24 |
| 4,944,256 | A | * | 7/1990 | Matayoshi et al. | 123/90.24 |
| 5,025,761 | A | * | 6/1991 | Chen | 123/90.16 |
| 5,048,474 | A | * | 9/1991 | Matayoshi et al. | 123/90.18 |
| 5,148,783 | A | * | 9/1992 | Shinkai et al. | 123/90.16 |
| 5,937,809 | A | * | 8/1999 | Pierik et al. | 123/90.16 |
| 6,055,949 | A | * | 5/2000 | Nakamura et al. | 123/90.16 |

* cited by examiner

*Primary Examiner*—Weilun Lo
(74) *Attorney, Agent, or Firm*—John VanOphem

(57) ABSTRACT

A rocker assembly has a first arm for following a first or opening camshaft lobe, a second arm for following a second or closing camshaft lobe, and a pivot axis of the rocker arm therebetween. A captive roller follower on the first arm follows the first lobe, and a slider on the second arm follows the second lobe. An eccentric pivot pin for the rocker assembly is rotatable to change the location of the pivot axis of the rocker assembly with respect to the captive roller and the slider, to adjustably set mechanical lash among these components after installation of the rocker arm assembly into a variable valve mechanism of an internal combustion engine.

7 Claims, 4 Drawing Sheets

MECHANICAL LASH ADJUSTER APPARATUS FOR AN ENGINE CAM

CROSS REFERENCE TO RELATED APPLICATION

This application is a Continuation-In-Part of a pending U.S. patent application, Ser. No. 09/755,345 filed Jan. 5, 2001.

TECHNICAL FIELD

The present invention relates to valve train systems for use on internal to combustion engines; more particularly, to devices for controllably varying the lift and/or timing of valves in such engines; and most particularly, to means for controlling the lash between the camshaft lobes and a two-arm rocker arm in a valve train system having cam lobes for both opening and closing an individual valve.

BACKGROUND OF THE INVENTION

Devices for controllably varying the degree of lift and the timing of opening and closing valves in internal combustion engines are well known. See, for example, U.S. Pat. No. 5,937,809 issued Aug. 17, 1999 to Pierik et al., and U.S. Pat. No. 6,019,076 issued Feb. 1, 2000 to Pierik et al., the relevant disclosures of which are herein incorporated by reference. Such a device is referred to in the art as a Variable Valve Mechanism (VVM). Such devices commonly employ a rocker assembly which pivots with or about a shaft or pin as a part of the apparatus train. Typically, the rocker assembly has a first bearing element, for example a roller, which follows the profile of a cam lobe during rotation of a camshaft.

Conventional variable valve mechanisms typically include many component parts, such as link arms, joints, pins, and return springs, and are thus relatively complex mechanically. Return springs are used typically to maintain the roller in contact with the input cam lobe and to reduce mechanical lash as the input cam lobe rotates from a high lift position to a low lift position. The use of such return springs negatively impacts the durability of the VVM and also may limit the operating range of the mechanisms, thereby limiting the operation of the intake valve throttle control system to a correspondingly-limited range of engine operation.

It is known to provide a second cam lobe per valve in place of return springs for closing the valve, and to employ a two-armed rocker assembly having appendages in contact with both the opening lobe and the closing lobe at all times. The angular orientation between the eccentrics of the opening and closing lobes on the camshaft defines the rotational angle through which the valve is open. Typically, the surface of the opening lobe is followed by a roller mounted on the first rocker arm, and the surface of the closing lobe is followed by a slider mounted on the second rocker arm. Such an arrangement provides positive control of the rocker assembly, and thus of the associated valve, at all positions of the camshaft and obviates the need for return springs.

A practical problem can arise in manufacturing and assembling such a two-lobe system. The stack-up of machining and mounting tolerances among the rocker, the roller, the pivot shaft for the rocker, the two cam lobes, and the camshaft mounting in the engine head can be formidable. Ideally, the roller and slider are just lightly in contact with the base circles of their respective cam lobes during the non-lift portions of the rotational cycle. If this lash relationship is too tight, i.e., zero or negative clearance, the valve may not open or close properly, or the rocker assembly may be stressed and distorted. If the lash relationship is too loose, the rocker assembly may clatter or chatter undesirably against the cam lobes, and the valve may not open fully or precisely in time.

What is needed is a simple means whereby the valve train components may be manufactured and assembled with loose tolerances and then the lash relationship of the cam followers to the cam lobes may be easily and precisely adjusted and retained after the valve train is assembled.

It is a principal object of the present invention to provide improved apparatus and method for setting the lash relationship of cam followers to cam lobes in a two-cam, two-follower valve train.

It is a further object of the invention to provide such a system wherein the setting may be conveniently and accurately done after the valve train is assembled.

SUMMARY OF THE INVENTION

Briefly described, a rocker assembly in accordance with the invention has a first arm for following a first or opening camshaft lobe and a second arm for following a second or closing camshaft lobe, the arms being designated with respect to a pivot axis of the rocker arm therebetween. Preferably, the first arm is provided with a captive roller follower and the second arm is provided with a captive sliding follower or slider. These elements are so selected for economy because opening of the valve is more mechanically demanding than is closing it. The pivot axis of the rocker assembly, the surface of the roller at the contact point with the opening lobe, and the surface of the slider at the contact point with the closing lobe, taken together define a triangle in space which must fit exactly into the space requirements of the valve train assembly of each valve in a multi-cylinder engine. An eccentric pivot pin for the rocker assembly is rotatable to change the location of the pivot axis of the rocker assembly with respect to the captive roller and the slider, thus to adjustably set mechanical lash between these components and their respective cam lobes after installation of the rocker assembly into a variable valve mechanism of an internal combustion engine.

BRIEF DESCRIPTION OF THE DRAWINGS

These and other features and advantages of the invention will be more fully understood and appreciated from the following description of certain exemplary embodiments of the invention taken together with the accompanying drawings, in which.

DESCRIPTION OF THE PREFERRED EMBODIMENTS

Figure 1:
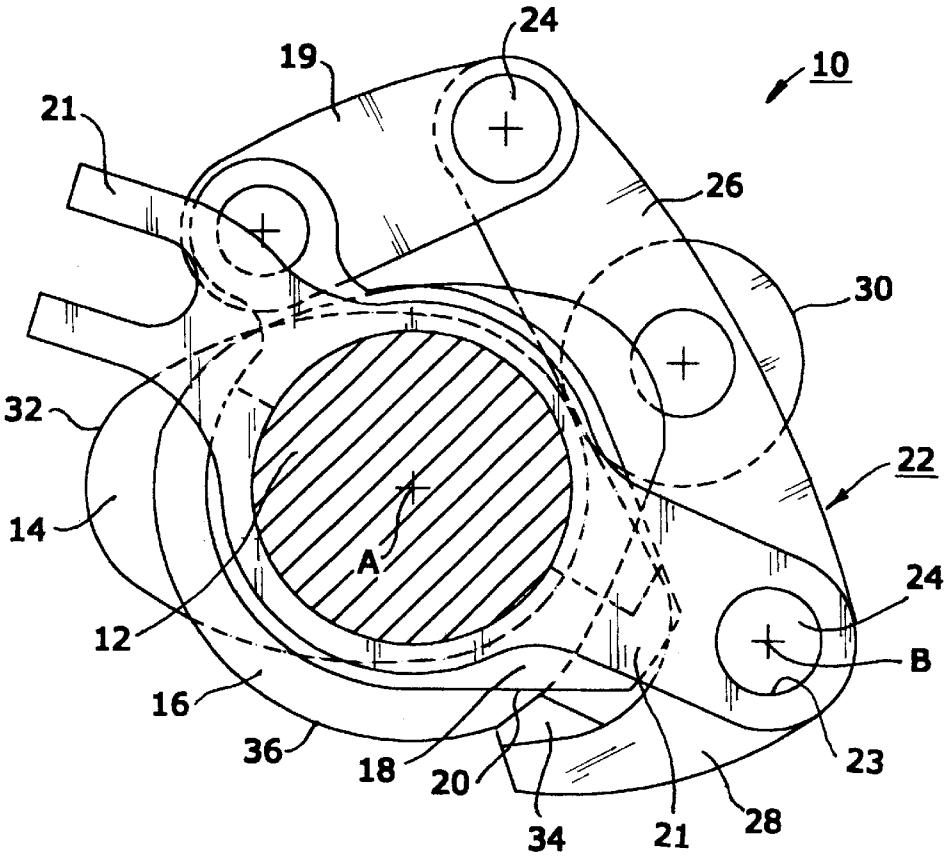
FIG. 1 is an elevational view of a variable valve mechanism for a double-lobe camshaft substantially as disclosed in the parent application, Ser. No. 09/755,345, having some components omitted for clarity, wherein the relative positions of the rocker assembly pivot axis, roller, and slider are fixed and not adjustable.

Referring to FIG. 1, there is shown a portion of a variable valve mechanism 10, including an input camshaft 12 on which are mounted valve-opening cam lobe 14 and valve-closing cam lobe 16. The cam lobes are disposed in a predetermined angular relation relative to each other and relative to central axis A of input shaft 12. The paired lobes 14,16 (only one pair shown) are spaced along the length of input shaft 12. Each respective pair of cam lobes 14,16 is associated with a corresponding variable valve mechanism 10 and with a corresponding cylinder of an internal combustion engine (not shown). For purposes of clarity, a single variable valve mechanism 10 is discussed hereafter.

Opening cam lobe 14 and closing cam lobe 16 rotate as substantially one body with input shaft 12. The lobes are, for example, affixed to or integral with shaft 12 which is received within and extends through rotary bearing mounts disposed on the head of the engine.

Output cam 18 is oscillatably disposed on shaft 12 for actuation of a valve stem, tappet, or roller finger follower (none shown) in known fashion via contact with eccentric surface 20. Cam 18 is pivotably connected to link 19 which is an elongate arm member pivotably coupled at a first end to output cam 18 and at a second and opposite end to rocker assembly 22. Rocker assembly 22 is coupled, for example, by pins 24, to link 19 and to a frame member 21 about which it pivots upon axis B. The frame member 21 may be independently rotated to various positions about shaft 12 to advance or retard the timing of valve opening, as disclosed in the incorporated reference patents. Rocker assembly 22 may be thought of as comprising two arms 26,28. First arm 26 carries roller 30 which followingly engages valve-opening cam lobe 14 along eccentric surface 32 and is pivotably pinned to link 19 as discussed above. As shaft 12 and lobe 14 rotate, roller 30 causes assembly 22 to pivot about axis B, thus causing, via link 19, output cam 18 to oscillate about shaft 12.

Rocker assembly 22 further includes a following slider pad 34 disposed on second arm 28 which slidingly engages valve-closing cam lobe 16 along eccentric surface 36. Lobes 14,16 are so shaped and oriented, and arms 26,28 are so oriented with respect to axis B that followers 30,34 are substantially in contact with eccentric surfaces 32,36, respectively at all times during rotation of shaft 12. Thus the action of rocker assembly 22 is fully controlled at all times and does not require use of return springs to assure proper motion. (In practice, the lash adjustment of the system optimally provides for a rest clearance of about 0.001" between slider 34 and surface 36.)

As noted above, there is little room for error in the manufacture and installation of the components shown in FIG. 1, or of the receiving engine head and VVM mounting components as well. Assembly 22 must have roller 30 and slider 34 positioned accurately with respect to axis B such that they just touch surfaces 32,36, respectively. It is a principal object of the invention to provide apparatus and method whereby the position of the slider may be adjusted post-assembly to achieve the required degree of accuracy and optimal amount of lash.

Figure 2:
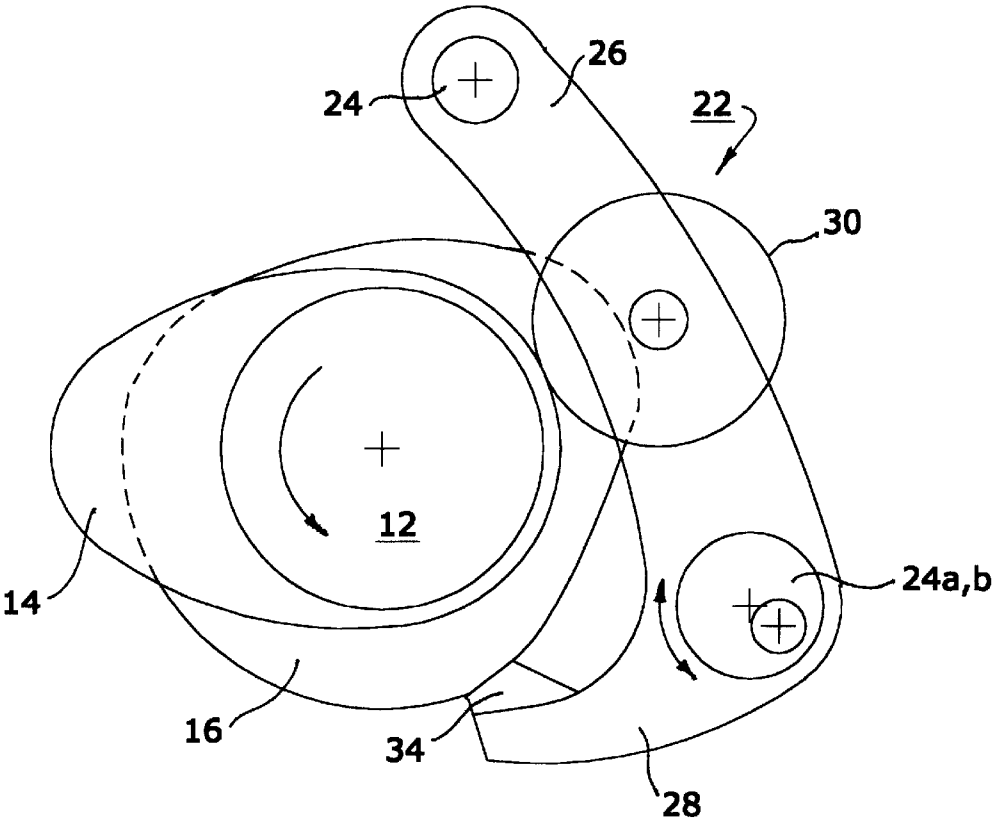
FIG. 2 is an elevational view of a rocker assembly in accordance with the invention, showing an eccentric pivot pin for the rocker assembly.

Referring to FIG. 2, rocker assembly 22 is substantially as configured in FIG. 1. However, pivot pin 24 is replaced with an improved pivot pin, shown as 24*a*,24*b*,24*c* in FIGS. 3–5 and as discussed below. The improved pivot pin has at least two cylindrical sections 38,40. The first cylindrical section 38 has an axis 42 coaxial with the axis of bore 23 of mounting frame 21 for rocker assembly 22. The second cylindrical section 40 has an axis 44 coaxial with pivot axis B of rocker assembly 22. Axes 42 and 44 are parallel but not coaxial; the axes are offset by a predetermined amount. Thus, by rotating the improved rocker pivot pin with an appropriate tool such as a hexagonal wrench applied to hexagonal socket 46 in the end of the pivot pin, the distance of axis B from cam lobes 14,16 is changed, thus changing the lash between the lobes and their followers. The amount of change in clearance or lash is a function of the angle through which the pin is rotated and the eccentricity of the pin (distance between axes 42 and 44). The eccentricity needed can be determined at the design stage after an analysis of the stack-up of manufacturing variances of the components of the VVM 10.

There are several variations in configuration of an improved pin having two offset cylindrical sections. The diameters of the sections can be of various sizes, depending upon the desired arrangement of components. For example, the designer may choose to have the smaller diameter in the supporting frame 21 or the rocker assembly and the larger diameter in the rocker assembly, or vice versa.

Figure 3:
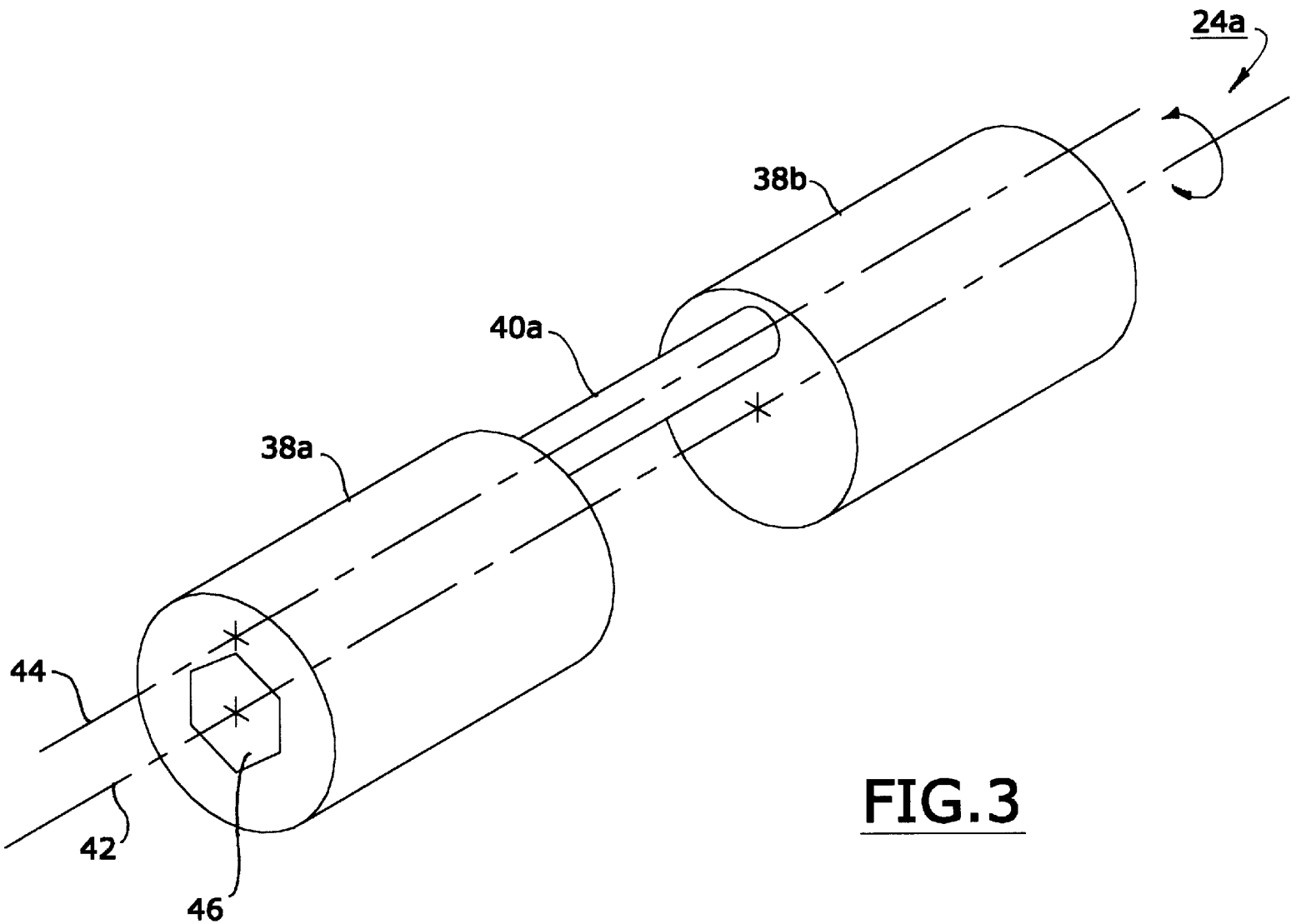
FIGS. 3 through 5 are isometric views of three separate embodiments for eccentric pivot pins as shown in FIG. 2.

Referring to FIG. 3, an improved pin 24*a* has two relatively large diameter first sections 38*a*,38*b* separated by a relatively small diameter second section 40*a*. Pin 24*a* is useful where frames 21 on either side of rocker assembly 22 have large diameter bores 23 for receiving the relatively large diameter sections 38*a*,38*b*, and assembly 22 has a relatively small diameter bore for receiving section 40*a* of pin 24*a*.

Figure 4:
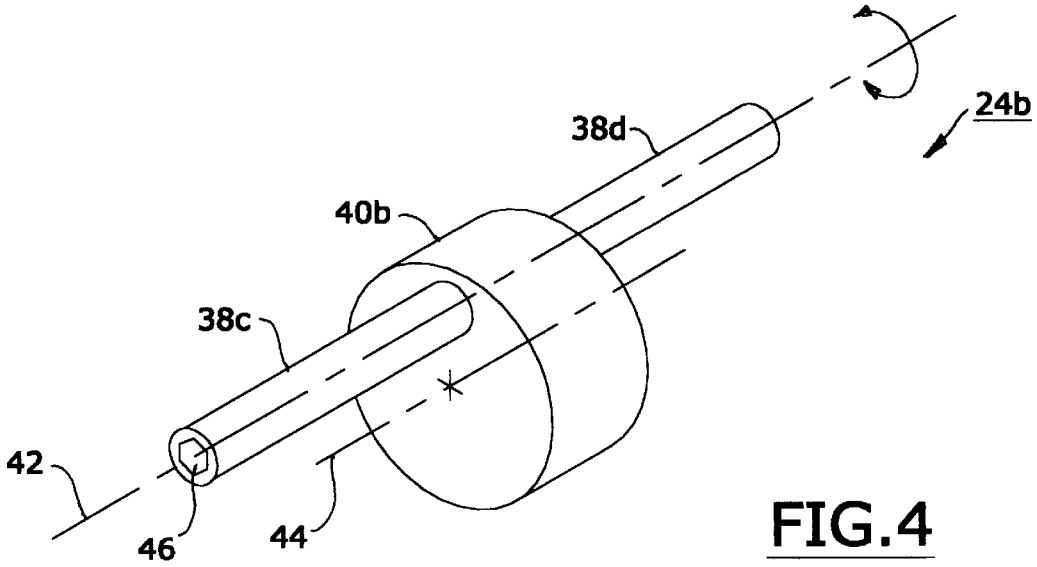

Conversely, referring to FIG. 4, an improved pin 24*b* has two relatively small diameter first sections 38*c*,38*d* separated by a relatively large diameter second section 40*b*. Pin 24*a* is useful where frames 21 on either side of rocker assembly 22 have small diameter bores 23 for receiving the relatively small diameter sections 38*c*,38*d*, and assembly 22 has a large diameter bore for receiving section 40*b* of pin 24*b*.

Figure 5:
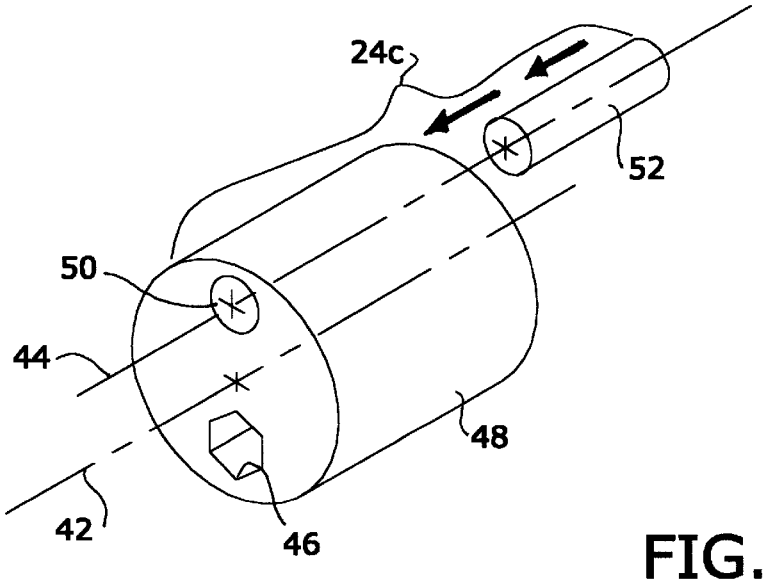

Referring to FIG. 5, the desired eccentric adjustment maybe obtained through use of either single or multiple cylindrical bushing(s) 48 disposed in either the frame bore 23 or the rocker assembly bore. Bushing 48 has an off-center bore 50 for receiving a cylindrical pin 52 substantially equivalent to prior art pin 24, disposable in either the corresponding assembly bore or frame bore to form an equivalent eccentric pin 24*c*. As in use of pins 24*a* and 24*b*, by rotating bushing 48 as by a hexagonal wrench, the mechanical lash in a VVM 10 may be adjusted.

It should be understood that in all embodiments in accordance with the invention, known means are to be employed for restricting further rotation of the eccentric pin after lash adjustment is complete, as by staking, set screws, clamps, and the like.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. An internal combustion engine comprising a variable valve mechanism including a rocker assembly pivotable about a pivot pin having a pivot axis for following a valve-opening cam lobe and a valve-closing cam lobe, said mechanism having a frame for pivotably supporting said rocker assembly, said pivot pin being disposed in first and second bores in said frame and said rocker assembly, respectively, for pivoting of said rocker assembly relative to said frame about said pivot axis, said pin having first and second cylindrical elements having first and second axes, respectively, said first and second axes being parallel and offset from each other, such that rotation of said pivot pin in said first and second bores changes the location of said pivot axis with respect to said frame and to said cam lobes.

2. A pivot pin disposable in first and second bores in first and second elements, respectively, for pivoting of the second element relative to the first element about a pivot axis, said pin comprising first and second cylindrical elements having first and second axes, respectively, said first and second axes being parallel and offset from each other, such that rotation of said pivot pin in said first and second bores changes the location of said pivot axis with respect to said first element wherein said first element is a frame pivotably disposed on an input camshaft and said second element is a rocker assembly.

3. A rocker assembly pivotable about a pivot axis for following a valve-opening cam lobe and a valve-closing cam lobe of a variable valve mechanism in an internal combustion engine, the mechanism having a frame for pivotably supporting the rocker assembly, comprising:

a) a first arm;

b) a first follower on said first arm for following said valve-opening cam lobe;

c) a second arm disposed at an included angle from said first arm;

d) a second follower on said second arm for following said valve-closing cam lobe; and e) a pivot pin disposable in said frame and disposed in said rocker assembly for pivoting of said rocker assembly about said pivot axis with respect to said frame, said pin having first and second cylindrical elements having first and second axes, respectively, said first and second axes being parallel and offset from each other, such that rotation of said pivot pin in said frame and said rocker assembly changes the distance between said pivot axis and said valve-opening and valve-closing cam lobes.

4. A rocker assembly in accordance with claim 3 wherein the diameter of said first cylindrical element is greater than the diameter of said second cylindrical element.

5. A rocker assembly in accordance with claim 3 wherein the diameter of said second cylindrical element is greater than the diameter of said first cylindrical element.

6. A rocker assembly in accordance with claim 3 wherein one of said first and second cylindrical elements is a cylindrical pin insertable through an off-center longitudinal bore in the other of said cylindrical elements.

7. A variable valve mechanism for an internal combustion engine, comprising a rocker assembly pivotable about a pivot pin having a pivot axis for following a valve-opening cam lobe and a valve-closing cam lobe of the variable valve mechanism in an internal combustion engine, said mechanism having a frame for pivotably supporting said rocker assembly, said pivot pin being disposable in first and second bores in said frame and said rocker assembly, respectively, for pivoting of said rocker assembly relative to said frame about said pivot axis, said pin having first and second cylindrical elements having first and second axes, respectively, said first and second axes being parallel and offset from each other, such that rotation of said pivot pin in said first and second bores changes the location of said pivot axis with respect to said frame and to said cam lobes.

* * * * *